US005921861A

United States Patent [19]

Yoon

[11] Patent Number: 5,921,861

[45] Date of Patent: Jul. 13, 1999

[54] AIR CONDITIONER HAVING ROTATABLE AIR DIRECTION CONTROL BLADES

[75] Inventor: Yeon-Seob Yoon, Suwon, Rep. of Korea

[73] Assignee: Samsung Electronics, Co., Ltd., Suwon, Rep. of Korea

[21] Appl. No.: 08/933,867

[22] Filed: Sep. 19, 1997

[30] Foreign Application Priority Data

Oct. 19, 1996 [KR] Rep. of Korea ..... 96-46974

[51] Int. Cl.[6] ..... F24F 13/075

[52] U.S. Cl. ..... 454/285; 454/320

[58] Field of Search ..... 454/153, 155, 454/202, 285, 313, 315, 319, 320, 325

[56] References Cited

U.S. PATENT DOCUMENTS 5,072,657 12/1991 Sakai ..... 454/285 X 5,338,251 8/1994 Matsumoto ..... 454/285 X

*Primary Examiner*—Harold Joyce

*Attorney, Agent, or Firm*—Burns, Doane, Swecker & Mathis, L.L.P.

[57] ABSTRACT

An air conditioner has a discharge outlet for discharging air, and a plurality of adjustable blades arranged across the outlet for controlling the direction of air discharged through the outlet. The blades are rotatable about parallel axes and are arranged in groups of blades. Each group is connected to a reciprocable connecting rod, whereby the blades rotate when their respective connecting rod is reciprocated. The connecting rods are interconnected in end-to-end relationship by slip joints. A motor connected to one of the connecting rods can reciprocate all of the connecting rods together for simultaneously adjusting all blades. When the motor is off, the blade groups can be manually rotated relative to one another, as permitted by slippage in the slip joints.

6 Claims, 4 Drawing Sheets

AIR CONDITIONER HAVING ROTATABLE AIR DIRECTION CONTROL BLADES

BACKGROUND OF THE INVENTION

1. Field of the Invention

The present invention relates to an air direction control apparatus of an air outlet of an air conditioner, for changing the direction of flow of discharged air.

2. Description of the Prior Art

A conventional air direction control apparatus of an air conditioner is disposed at an upper area of a cabinet 1 thereof, as illustrated in FIGS. 1 and 2, and extends across a discharge outlet 3 for discharging indoors the air which has been infused into the cabinet 1 and heat-exchanged therein.

The discharge outlet 3 is provided with a plurality of horizontal control blades 5 and vertical control blades 7 for controlling the vertical and horizontal directions, respectively, of the air supplied into a room.

Furthermore, the discharge outlet 3 is provided at one side thereof with an air direction control apparatus for changing the inclinations of the blades 5 and 7 to thereby control the air flow direction. That air direction control apparatus according to the prior art is, as illustrated in FIG. 3, coupled with a plurality of blades 11 which could correspond to either the blades 5 or the blades 7.

Each of the blades 11 carries aligned pins 11*a*, 11*b* which are pivotally mounted to fixed support plates (not shown). Each blade 11 includes also a pin 11*c* coupled to a connecting rod 13 for simultaneously rotating the plurality of blades 11.

The connecting rod 13 is connected to a motor (not shown) via a predetermined known power transmission mechanism for changing a rotary motion of a motor output shaft to a rectilinear motion of the rod 13.

In the prior art air direction control apparatus of an air conditioner thus constructed, when the motor is rotated by a predetermined amount to rectilinearly move the connecting rod 13 via a power transmission mechanism, the blades 11 are rotated to a predetermined inclination. Then the motor 31 is stopped.

However, there is a problem in the air direction control apparatus of an air conditioner thus constructed according to the prior art, in that all of the blades 11 are coupled to one connecting rod 13, so that, as illustrated in FIGS. 4A, 4B and 4C, all of the blades move together in the same direction and thus all blades discharge the air in the same direction. This limits the versatility of air flow control.

SUMMARY OF THE INVENTION

Accordingly, the present invention is presented to solve the aforementioned problem and it is an object of the present invention to provide an air direction control apparatus of an air conditioner by which a discharged direction of the air can be varied to thereby allow the air to be directed to more predetermined directions desired by a user.

In accordance with the object of the present invention, there is provided an air direction control apparatus of an air conditioner comprising more than one connecting rod each provided with a blade group, the connecting rods being interconnected by slip joints for obtaining the various discharged air directions.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF A PREFERRED EMBODIMENT OF THE INVENTION

A preferred embodiment of the present invention will now be described in detail with reference to the accompanying drawings.

Figure 1:
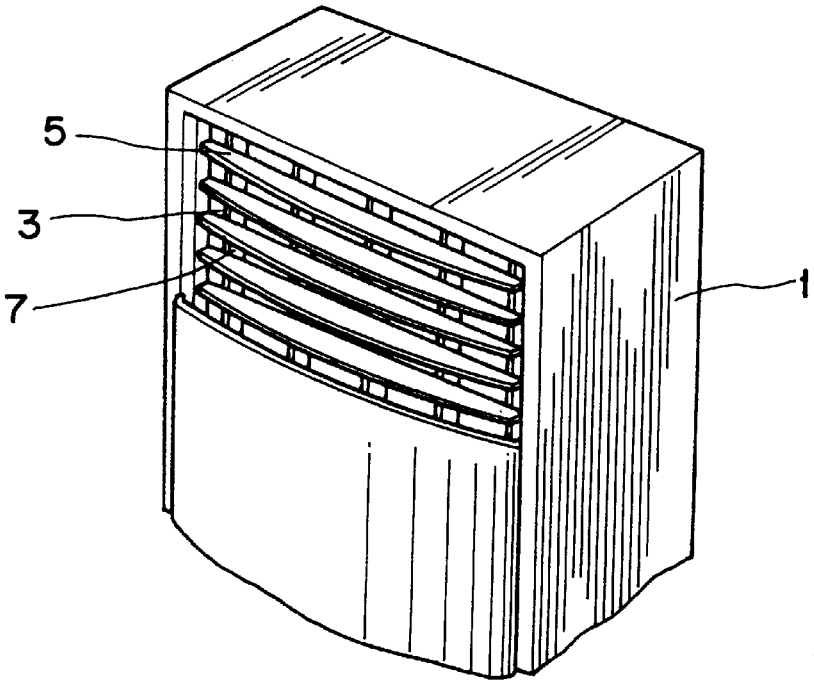
FIG. 1 (PRIOR ART)
FIG. 1 is a perspective view illustrating part of a conventional air conditioner having air direction control blades.
Figure 2:
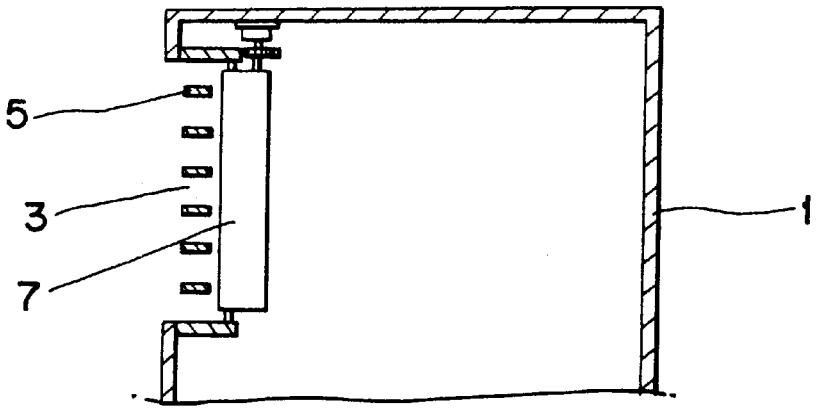
FIG. 2 (PRIOR ART)
FIG. 2 is a vertical sectional view through FIG. 1.
Figure 3:
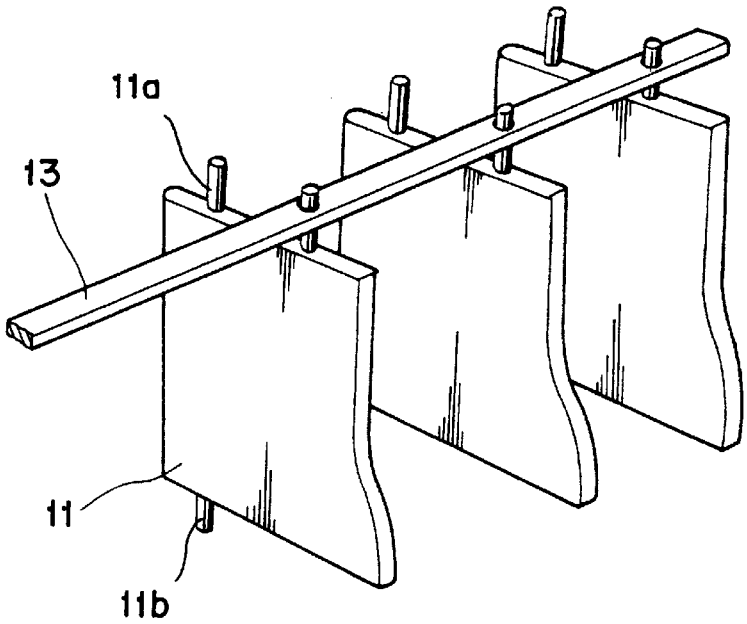
FIG. 3 is a schematic view of the conventional air direction control blades.
Figure 4A:
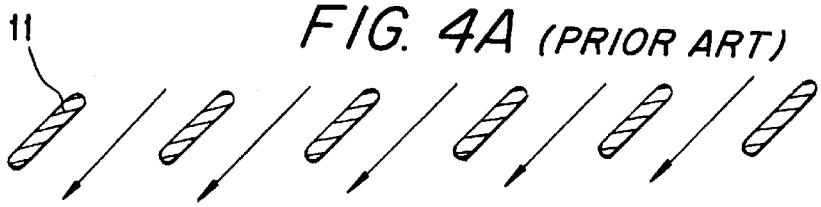
FIG. 4A (PRIOR ART)
FIGS. 4A, 4B and 4C are schematic diagrams of respective blade orientations achieved according to the operation of the conventional air direction control apparatus.
Figure 4B:
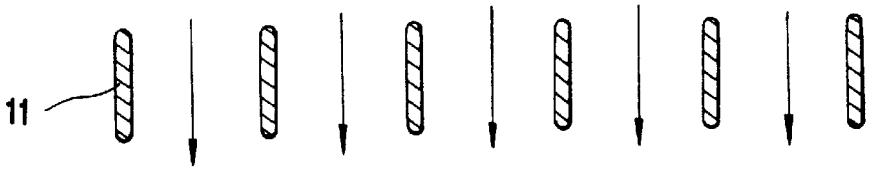
FIG. 4B (PRIOR ART)
Figure 4C:
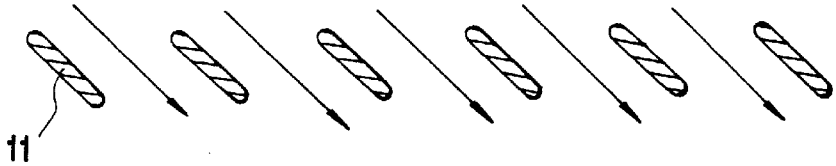
FIG. 4C (PRIOR ART)
Figures 5, 6:
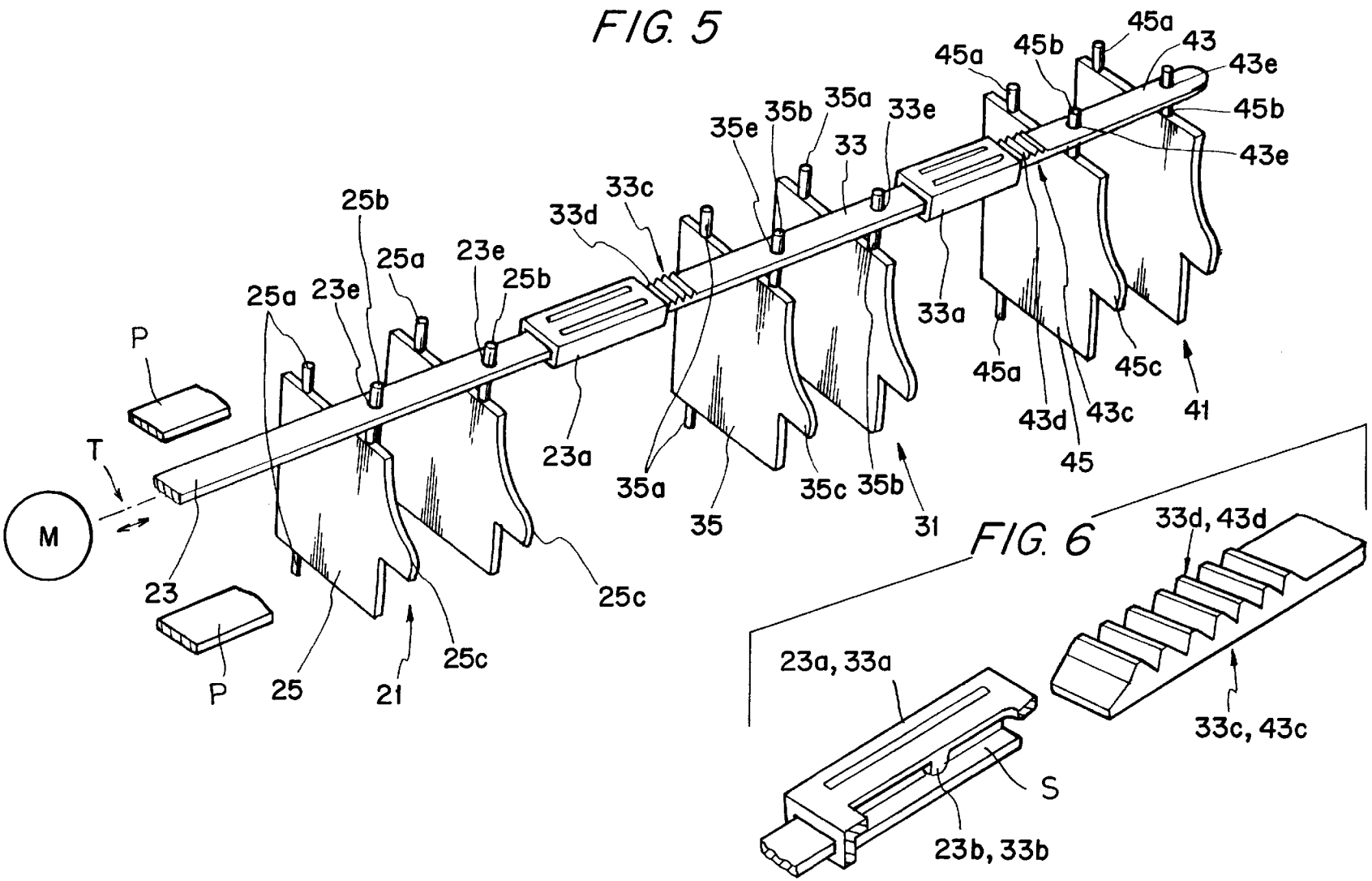
FIG. 5 is a perspective view of an air direction control apparatus of an air conditioner according to an embodiment of the present invention.
FIG. 6 is an exploded perspective view of a slip joint shown in FIG. 5.
Figure 7A:
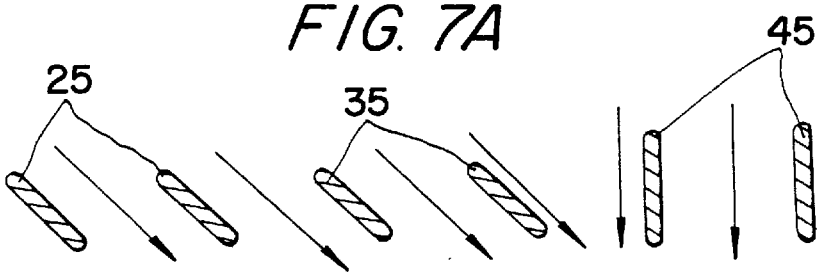
FIGS. 7A through 7E are schematic diagrams of respective blade orientations achieved by the air direction control apparatus according to the embodiment of the present invention.
Figure 7B:
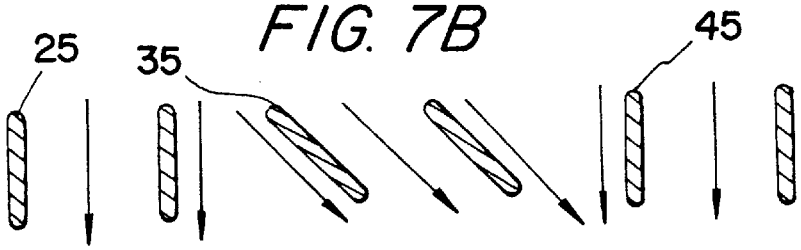
Figure 7C:
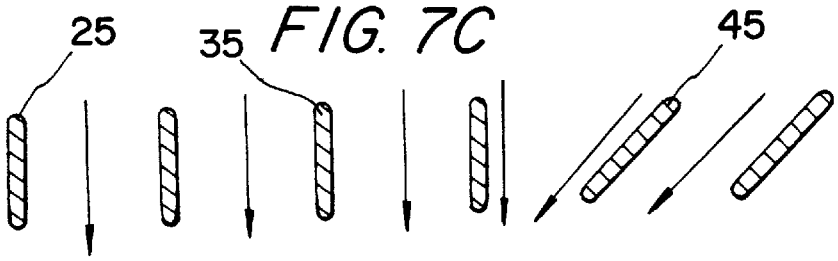
Figure 7D:
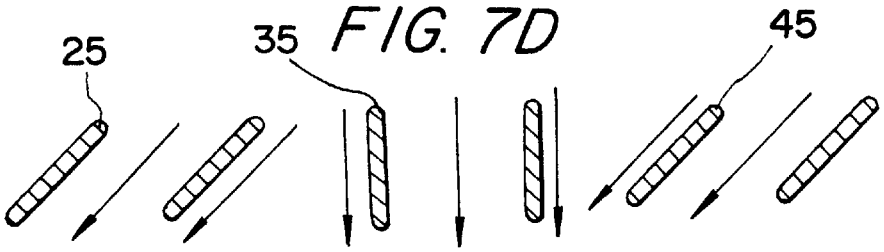
Figure 7E:
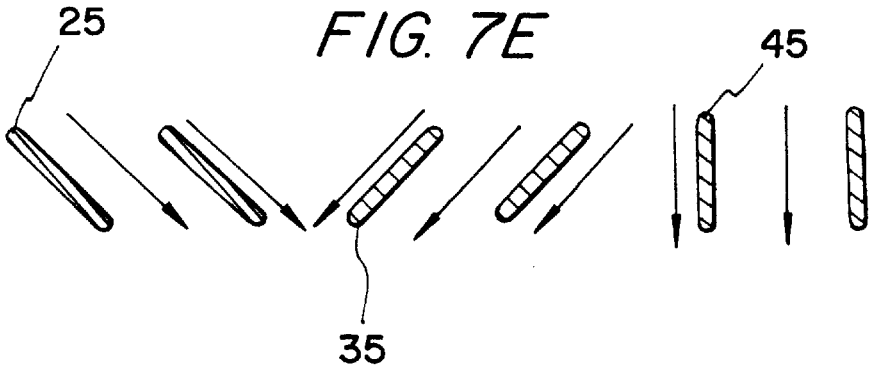

As illustrated in FIG. 5, first, second and third blade groups 21, 31 and 41 of an air flow directing apparatus are respectively coupled to first, second and third connecting rod 23, 33 and 43, for adjusting the blades and varying the discharged air directions. The blades can be either vertical or horizontal blades.

The first, second and third blade groups 21, 31 and 41 include pairs of parallel blades 25, 35 and 45 respectively. Each connecting rod 23, 33 and 43 comprises a relatively narrow long plate. The connecting rods 23, 33, 43 are connected in end-to-end relationship and are reciprocably displaceable in a linear direction.

The first connecting rod 23 is connected at a left end thereof to a motor M via any suitable known power transmission mechanism T which converts a rotary motion of the motor output shaft to a rectilinear motion of the rod 23, and is fixedly connected at a right end thereof to a slip joint in the form of an accommodation or connector part 23*a* which connects to a rack part (described later) of the second connecting rod 33.

The second connecting rod 33 is provided at a right end thereof with another slip joint in the form of an accommodation or connector part 33*a* which connects to a rack part (described later) of the third connecting rod 43, and is provided at a left end thereof with a rack part 33*c* formed with ratchet teeth 33*d*. The third connecting rod 43 is provided at a left end thereof with a rack part 43*c* formed with ratchet teeth 43*d*.

Furthermore, each of the first, second and third connecting rods 23, 33 and 43 is formed at a middle section thereof with two through holes 23*e*, 33*e*, 43*e*, through which protruders 25*b*, 35*b*, 45*b* (described later) of the blades 25, 35 and 45 are loosely inserted.

Each of the connector parts 23*a* and 33*a* forms a socket S for receiving the respective rack parts 33*c* and 43*c*, and in each socket S there is provided a pair of protruders 23*b*, 23*b* and 33*b*, 33*b* engaged with to the ratchet teeth 33*d* and 43*d*, respectively.

Each of the blades 25, 35 and 45 is provided with two aligned rotary axle parts 25*a*, 35*a* and 45*a* which are rotatively mounted in stationary support plates P, P. Each of the blades 25, 35 and 45 is also provided on an edge thereof with a protruder 25*b*, 35*b* and 45*b*, each protruder being disposed at a predetermined interval from the rotary axle parts 25*a*, 35*a* and 45*a* so that the blades 25, 35 and 45 can be respectively rotated around the rotary axle parts 25*a*, 35*a* and 45*a* according to reciprocation of the first, second and third connecting rods 23, 33 and 43.

Each of the blades 25, 35 and 45 is formed on a front surface thereof with a handle part 25*c*, 35*c*, 45*c*, which enable the blades to be manually rotated.

The motor power for moving the connecting rods 23, 33 and 43 is less than the meshing force between the ratchets 33*d* and 43*d* and the protruders 23*b* and 33*b*. Furthermore, the meshing force between the ratchets 33*d* and 43*d* and the protruders 23*b* and 33*b* is less than a manual power of an ordinary person. Thus, by actuating the motor, all of the connecting rods can be moved together as a unit to rotate all blades simultaneously by the same amount. On the other hand, when the motor is de-energized, the blade groups can be rotated independently of one another.

Now, the operation of the air direction control apparatus of an air conditioner according to the preferred embodiment of the present invention will be described.

When the motor M is activated to apply a motorized displacement force to simultaneously move the connecting rods 23, 33 and 43 rectilinearly, the protruders 25*b*, 35*b* and 45*b* are rotated about axes defined by the rotary axle parts 25*a*, 35*a* and 45*a*, thereby causing the blades 25, 35 and 45 to be rotated together by a predetermined angle.

Because the motor power for moving the connecting rods 23, 33 and 43 is less than the meshing force between the ratchets 33*d* and 43*d* of the connecting rod and the protruders 23*b* and 33*b*, the connecting rods 23, 33 and 43 do not move relative to one another. The motor is stopped of its operation by control means (not shown) when the blades 25, 35 and 45 reach a predetermined inclination.

When the motor M is stopped, any blade 25, 35 and/or 45 can be manually rotated to the left or right by way of the handles 25*c*, 35*c* and 45*c*. The protruders 25*b*, 35*b* and 45*b* of each blade 25, 35 and 45 in tuan push the respective connecting rod 23, 33 and/or 43 to the left or right, whereby, the protruders 23*b* and 33*b* of the connector parts 23*a* and/or 33*a* slip over the ratchets 33*d* and/or 43d, so that, as illustrated in FIGS. 7A through 7E, the blades of the blade groups 21, 31 and 41 can be selectively oriented in different inclinations to thereby make it possible to vary the discharged air directions.

In order to make certain ones of the manual adjustments, it may be necessary 15 to manually restrain one group of blades while rotating another group in order to produce slippage at the slip joint. For example, in the event that it is desired to manually rotate the handle 35*c* of a blade 35 in a direction toward the blade group 41, without producing a simultaneous rotation of the blades 45 (e.g. to produce the flow pattern shown in FIG. 7B), the handle 45*c* of one of the blades 45 should be gripped and held stationary, to ensure that the necessary slippage at the slip joint 33*a* is produced.

Likewise, if a blade handle 45*c* is to be rotated toward and relative to the blade group 31, one of the blade handles 35*c* should be gripped in order to hold the blade group 31 stationary and to ensure that the necessary slippage at the slip joint 33*a* is produced.

Although there has been disclosed three blade groups each having 2 blades, it should also be noted that the air directing apparatus may comprise many blade groups having more than two blades.

As is apparent from the foregoing, there is an advantage in the air direction control apparatus of an air conditioner according to the present invention, in that the blades can be rotated simultaneously as a group by means of a motor, or the blades can be manually rotated relative to one another, thereby allowing the air to be discharged in numerous different flow patterns.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. An air conditioner having an inlet for receiving air to be changed in temperature, an outlet for discharging the air, and a plurality of adjustable blades disposed across the outlet for defining selected discharge directions of the air, the blades being adjustably rotatable about parallel axes, the blades comprising groups of blades, each blade group including a connecting rod connected to all of the blades of the respective group, the connecting rods being displaceable to simultaneously rotate the associated blades to selected positions of adjustment, adjacent connecting rods being interconnected by a slip joint to enable the blade groups to be rotated relative to one another, wherein the connecting rods are displaceable reciprocably in a linear direction, the connecting rods being aligned in an end-to end relationship in the linear direction, wherein the slip joint comprises ratchet teeth carried by one connecting rod, and a projection carried by an adjacent connecting rod, the projection engaging the ratchet teeth.

2. The air conditioner according to claim 1 further including a motor connected to one of the connecting rods for applying a motorized displacement force to the one connecting rod, a connection force defined by the slip joint for securing the connecting rods together being stronger than the motorized displacement force so that all of the connecting rods are displaced simultaneously by the motor, the connection force able to be overcome by manual force to enable the connecting rods to be manually displaced relative to one another.

3. The air conditioner according to claim 1 wherein there are more than two blade groups and associated connecting rods, each connecting rod connected to at least one adjacent connecting rod by a slip point.

4. The air conditioner according to claim 1 wherein each blade includes a handle part oriented to be manually gripped.

5. An air conditioner having an inlet for receiving air to be changed in temperature, an outlet for discharging the air, and a plurality of adjustable blades disposed across the outlet for defining selected discharge directions of the air, the blades being adjustably rotatable about parallel axes, the blades comprising at least three groups of blades, each group comprising at least two blades, each blade group including a connecting rod connected to all of the blades of the respective group, the connecting rods being connected in an end-to-end relationship by means of slip joints, each slip joint comprising ratchet teeth carried by one connecting rod and a projection carried by another connecting rod and being engaged with the ratchet teeth, the connecting rods being reciprocable in a liner direction, a motor connected to one of the connecting rods for displacing all of the connecting rods simultaneously, each of the slip joints accommodating relative displacement between the blade groups in response to manual forces applied to the blade groups.

6. The air conditioner according to claim 5 wherein each blade includes a manually grippable handle portion enabling a manual force to be applied thereto.

* * * * *